US012053033B1

(12) United States Patent
Cortese

(10) Patent No.: US 12,053,033 B1
(45) Date of Patent: Aug. 6, 2024

(54) SHIRT WITH PARTIALLY FALSE BUTTON CLOSURE

(71) Applicant: Chelsea Cortese, Napa, CA (US)

(72) Inventor: Chelsea Cortese, Napa, CA (US)

( * ) Notice: Subject to any disclaimer, the term of this patent is extended or adjusted under 35 U.S.C. 154(b) by 656 days.

(21) Appl. No.: 15/957,602

(22) Filed: Apr. 19, 2018

(51) Int. Cl.
*A41B 1/10* (2006.01)

(52) U.S. Cl.
CPC ..... *A41B 1/10* (2013.01); *A41B 2400/44* (2013.01)

(58) Field of Classification Search
CPC ..... A41B 1/10; A42B 2400/44
See application file for complete search history.

(56) References Cited

U.S. PATENT DOCUMENTS 2,341,798 A * 2/1944 Lesser ..... 2/115
2,846,687 A * 8/1958 Lippman ..... A41B 1/00 2/115
4,616,366 A * 10/1986 Mueller ..... A41B 1/10 2/115
5,084,914 A * 2/1992 Hesch ..... A41D 13/129 2/227
5,802,611 A * 9/1998 McKenzie ..... A41D 13/1236 2/69
6,260,200 B1 * 7/2001 Alfred ..... A41D 13/1263 2/69
6,698,025 B1 * 3/2004 Hughes ..... A41B 13/005 2/69
7,992,222 B1 * 8/2011 Behrens ..... A41B 1/10 2/128
9,622,512 B2 * 4/2017 Partsch, IV ..... A41B 3/06
2010/0125930 A1 * 5/2010 Burrell, IV ..... A41B 13/08 2/75
2011/0231982 A1 * 9/2011 Echikson ..... F41C 33/048 2/115
2012/0124713 A1 * 5/2012 Blauer ..... F41H 1/02 2/102
2018/0242667 A1 * 8/2018 Horton ..... A41D 1/18

* cited by examiner

*Primary Examiner* — Richale L Quinn
(74) *Attorney, Agent, or Firm* — Heisler & Associates

(57) ABSTRACT

The shirt includes a vertically extending front placket and a vertically extending rear placket which are selectively attachable together through buttons on the rear placket and buttonholes in corresponding positions through the front placket. The front placket and rear placket extend down from a neck opening to a junction. A false placket extends down from the junction. The false placket has appearance characteristics matching that of the front placket and is continuous with the front placket. Buttons on the false placket match buttons on the rear placket. The false placket thus appears as though it is a continuation of the buttoned front placket and rear placket. However, the false placket his unopenable. An additional closure is preferably provided, either in the form of a rear closure or a side closure. This additional closure can be fitted with a zipper or other fastener for selectively closing and opening this additional closure.

11 Claims, 3 Drawing Sheets

SHIRT WITH PARTIALLY FALSE BUTTON CLOSURE

FIELD OF THE INVENTION

The following invention relates to dress shirts of a button down front variety and other shirts with a button front. More particularly, this invention relates to shirts with a button front which include an upper portion which can open and close through buttoning and a lower portion which appears to be openable and closable with buttons, but which is permanently closed.

BACKGROUND OF THE INVENTION

Clothing of different functional types and styles are provided for covering various different portions of the body. Shirts are provided for covering at least portions of a torso of an individual. Shirts come in a very large variety of configurations, including fabric variations, sleeved and sleeveless, button front and other openable fronts, and pull over shirts with no openable portion thereon.

Shirts with a button front can include buttons on plackets running from the collar down a vertical centerline to the hem, or alternatively with buttons on the plackets which start at the collar and extend only partway down to the hem. Furthermore, some shirts include buttons which extend all the way up to the collar, and others include buttons which stop short of the collar. Fasteners other than buttons can also be utilized to close an openable front on a shirt, such as zippers, snaps, etc.

Generally, shirts with an openable front, and which front is fully openable, are considered to be the most formal and the most "business-like" in present day modern North American society. Furthermore, a fully openable front allows for the shirt to be donned without having to pull the shirt over a head of the wearer, which can be difficult for some disabled individuals, and can tend to damage styling applied to hair, which may have already been styled. Thus, in many instances, shirts with a fully openable button front are desirable. One disadvantage of such fully openable button front shirts is the potential for such shirts on many individuals to have undesirable gaps form between the buttons. Such gapping in the prior art is shown in FIGS. 8 and 9. Such gaps can cause undergarments beneath the shirt to be visible, or skin beneath the shirt. Furthermore, such gaps can distort the linear character of lateral edge and boundary edges of the placket, presenting a less desirable form.

Current solutions to this gapping problem include placing the buttons exceptionally close together to minimize the gapping. This solution however requires that many buttons be fastened to close the shirt, which can be a tedious and at times somewhat difficult task. Furthermore, the style desired for the shirt can be negatively influenced by requiring too many buttons. Even with a large number of buttons, gapping, while diminished, are not entirely eliminated.

Another solution is to utilize an additional fastener, such as two-sided tape, hook and loop fastener material, temporary fabric adhesive, etc. in a separate procedure to fight such gapping. While such techniques might be effective when posing for a portrait, when one has large amounts of time to deal with this problem, this solution is not effective or practical when regularly putting on and taking off a shirt. Accordingly, a need exists for a shirt which provides the form and style of a fully openable button front shirt, while eliminating the problem of gapping between buttons thereof.

SUMMARY OF THE INVENTION

With this invention, a shirt is provided which has the appearance of a fully openable button front, but which avoids the problem of gapping. The shirt can be collared or collarless, sleeved or sleeveless, formed of various fabrics, patterned or plain and otherwise can be configured following the variety of styles typically available for button front shirts which include buttons extending from the neck opening down to the lower hem along a vertical centerline. Uniquely, while the button front appears to be fully openable, it is in fact only openable on upper portions thereof. A junction partway between an upper end and a lower end of the buttonable front defines a transition. Above this transition, a rear placket supports buttons thereon and a front placket supports buttonholes thereon, which front placket and rear placket can be removably attachable together by inserting the buttons of the rear placket through the buttonholes in the front placket. Below this junction, a false placket is provided. The false placket has the same appearance as the front placket and with buttons thereon having the same appearance as those on the rear placket. Thus, the false placket appears like a portion of the openable front which has merely been closed by buttoning. However, this false placket is not openable.

In a preferred embodiment, the rear placket and front placket each extend up from the junction to a collar with a band thereon and with a top button and top buttonhole at opposite ends of this band. The front and rear plackets include lateral edges where the plackets terminate from further extension laterally. The front and rear plackets also have a boundary edge, in at least some embodiments. This boundary edge is spaced a uniform distance away from the lateral edge, defining widths of the plackets. Buttons or buttonholes are provided at a middle distance between the lateral edges and the boundary edges of the front placket and/or rear placket.

On the false placket, a first side of the second side are provided which generally have an appearance matching the lateral edge and boundary edge of the front placket. Thus, the false placket appears to be merely a continuation of the front placket. The rear placket is covered a greater and greater amount as it extends toward the junction by passing behind the front placket. Thus, the rear placket is hidden behind the front placket by the time it reaches the junction. While the rear placket can continue down within the false placket beneath a forward surface of the false placket, most preferably the rear placket merely stops at or near the junction.

Visually, the false placket appears to be the front placket overlying the rear placket, because the false placket includes buttons matching the buttons on the rear placket. Optionally, and if the buttonholes are longer than a diameter/width of the buttons on the rear placket, at least portions of buttonholes can be provided on the false placket adjacent to the buttons. This provides an appearance that the false placket is actually the front placket. Such false buttonholes (or portions thereof) do not have to be openable, but rather can merely include stitching similar to that provided with the buttonholes on the front placket, so that the false placket appears as though it is a continuation of the front placket, closed by buttoning to the rear placket.

Most preferably, a rear closure is provided on a rear of the shirt. In an alternative embodiment, this rear closure can be replaced with a side closure on a side of the shirt. Whether this additional closure is in the form of a rear closure or a side closure, it generally involves a vertical opening extending up from a tail of the shirt (or lower hem or other lower edge of the shirt), from a lower end to an upper end. This upper end most preferably is located at an elevation on the shirt similar to the junction. The zipper on the rear closure is at an upper position when the real closure is open and at a lower position when the real closure is closed.

The zipper is preferably of a concealed and low profile variety so that it is largely not visible when the rear closure is closed. Rather, the appearance of only a seam line is presented. Such a rear closure is particularly useful when the shirt is highly fitted to match a torso contour of the individual. For shirts that are less fitted, or shirts formed of fabrics which have a higher degree of stretch, a rear closure (or side closure) could be omitted.

When the rear closure is replaced with a side closure, a similar configuration is provided, only the location of this additional closure is moved to a side, such as directly beneath one of the armholes of the shirt. While such a side closure is shown having an upper end beneath an armhole, but near to the armhole, such an upper end could extend all the way to the armhole. On a sleeveless shirt, such a side closure could provide for a complete opening of the shirt through opening of the side closure, as an alternative.

OBJECTS OF THE INVENTION

Accordingly, a primary object of the present invention is to provide a shirt which has the appearance of a fully openable shirt in front, but which is actually only partially openable.

Another object of the present invention is to provide a shirt with the appearance of a fully openable button front, which avoids gapping between buttons and between a front placket and rear placket of the shirt.

Another object of the present invention is to provide a shirt which can be fitted closely to the anatomy of the wearer, without gapping between buttons in a front closure thereof.

Another object of the present invention is to provide a shirt with the appearance of a fully buttonable front which is easy to put on and take off, without needing to manipulate any of the buttons thereon (or only needing to manipulate one or a few buttons).

Other further objects of the present invention will become apparent from a careful reading of the included drawing figures, the claims and detailed description of the invention.

DESCRIPTION OF THE PREFERRED EMBODIMENT

Figure 2:
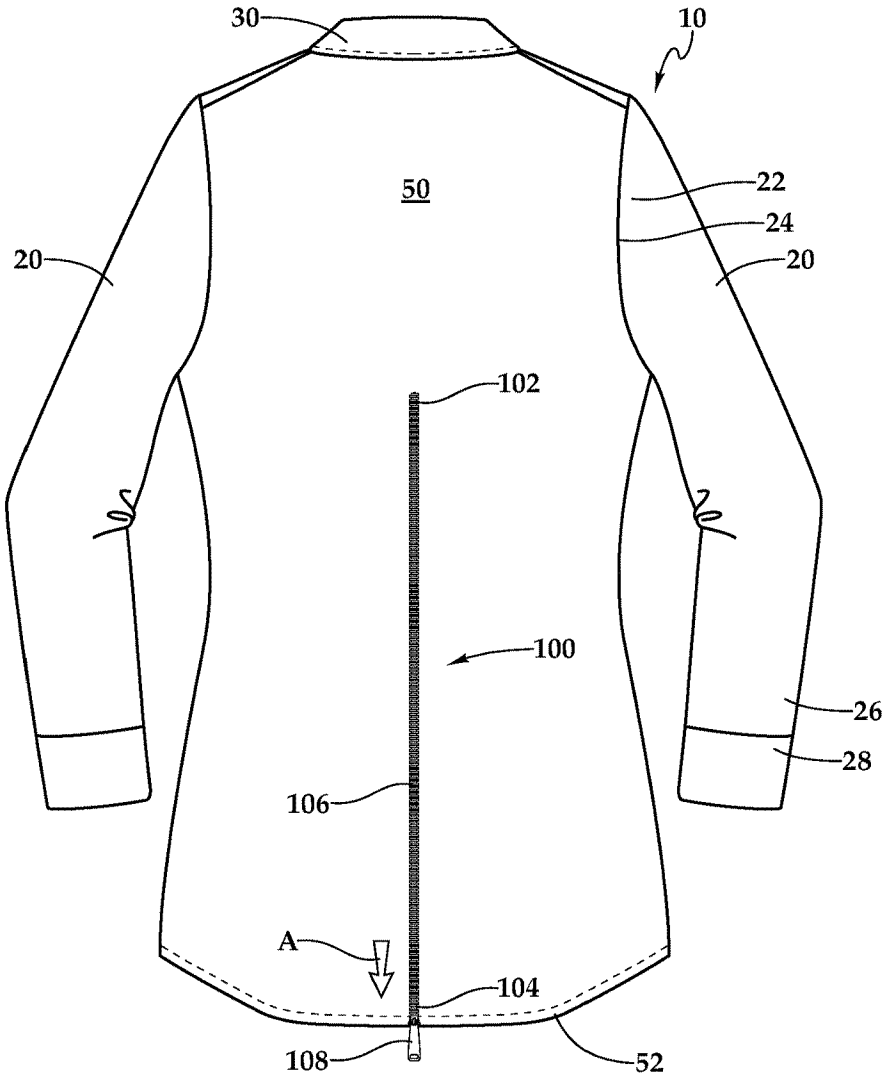
FIG. 2 is a rear elevation view of that which is shown in FIG. 1, and with a rear closure thereof shown closed.

Referring to the drawings, wherein like reference numerals represent like parts throughout the various drawing figures, reference numeral 10 is directed to a shirt according to one embodiment of this invention and featuring the partially false button closure of this invention. The shirt 10 includes plackets 60, 70, 90 which are openable above a junction 80, but unopenable below the junction 80, to provide appearance of a fully openable button front, but the function of only partial openability through action of buttons 65 and buttonholes 75. Gapping between buttons below the junction 80 is thus avoided.

In essence, and with particular reference to FIGS. 1-3, 6 and 7, basic details of the shirt 10 of this invention are described according to an exemplary embodiment. The shirt 10 can have a variety of different configurations, but generally includes a front 40 opposite a rear 50, and optionally with sleeves 20 and a collar 30. The front 40 is bisected vertically by placket structures including a rear placket 60 and front placket 70 above a junction 80, and with a false placket 90 extending downward from the junction 80. The front placket 70 includes buttonholes 75 thereon. The rear placket 60 include buttons 65 thereon. The false placket 90 includes false buttons 95, which, while real buttons, are false in that they do not act as fasteners, but rather only to match at least some of the visual characteristics of the buttons 65 of the rear placket 60. The shirt 10 also preferably includes a rear closure 100 on the rear 50, which is selectively openable and closable to assist in placing the shirt 10 upon a torso of a wearer.

Figure 1:
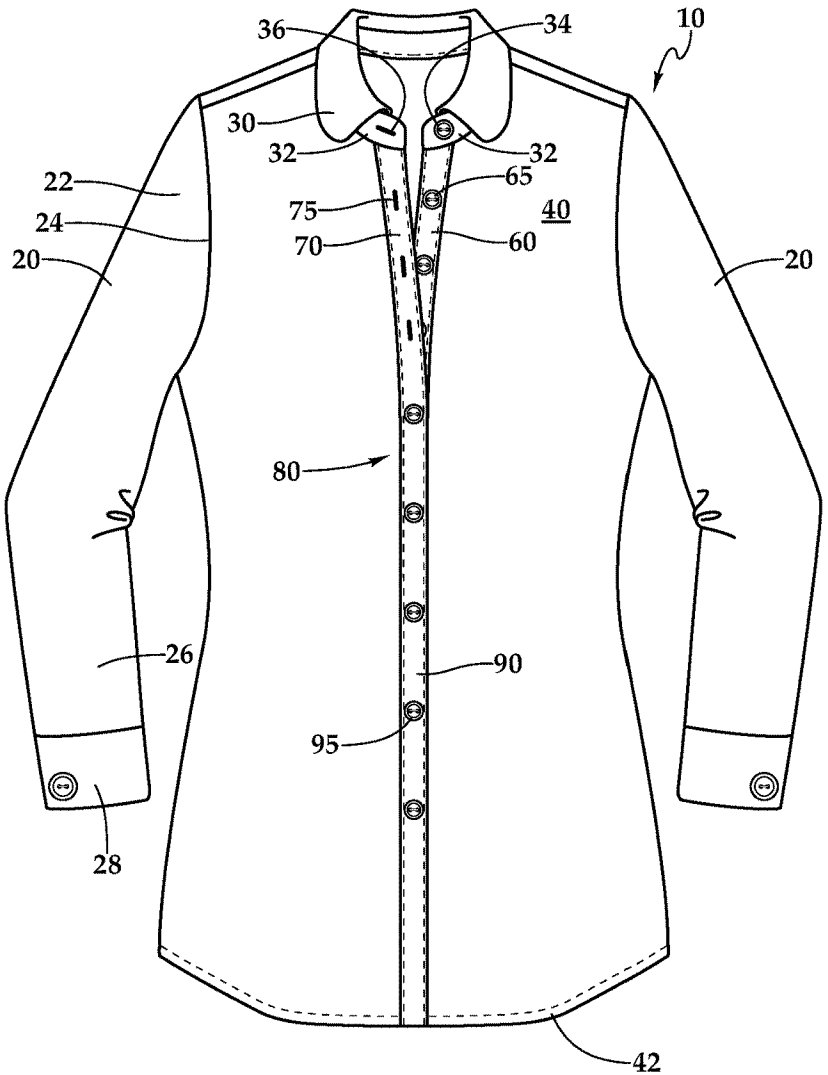
FIG. 1 is the front elevation view of a shirt according to a preferred embodiment of this invention and featuring a partially false buttonable front.
Figure 4:
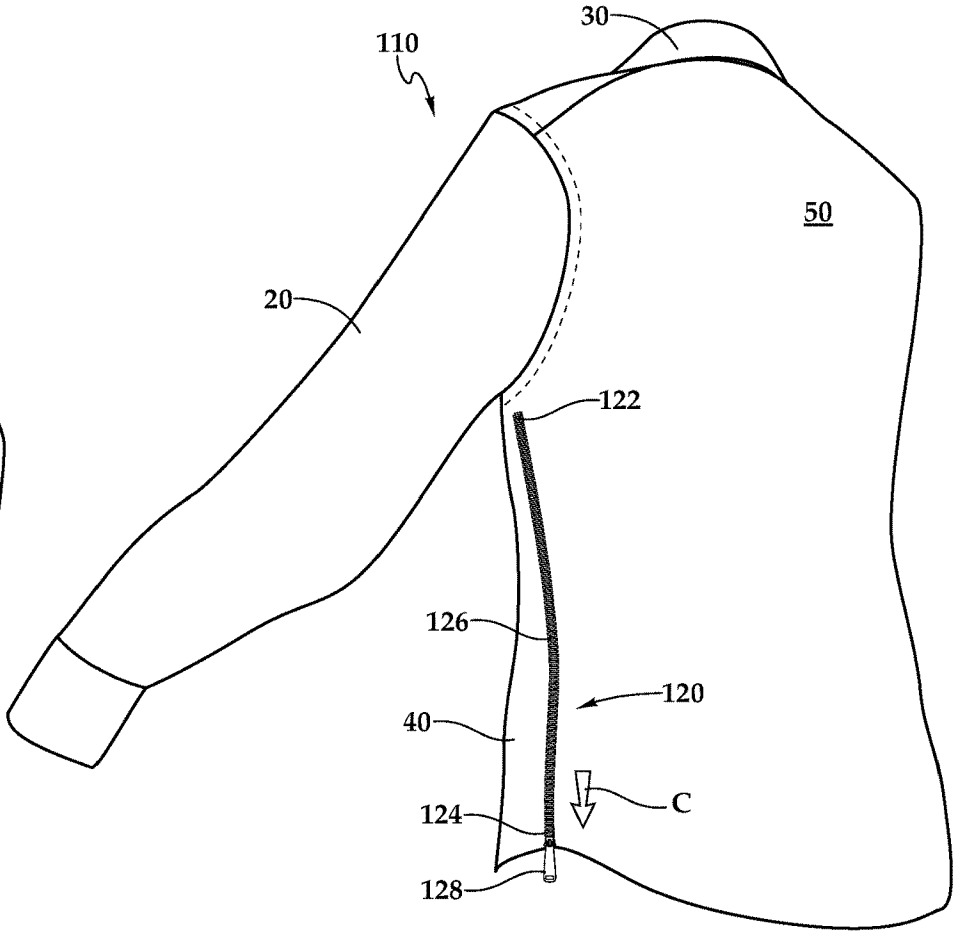
FIG. 4 is a rear perspective view of an alternative embodiment shirt of that which is shown FIGS. 1-3, which includes a side closure shown closed.
Figure 3:
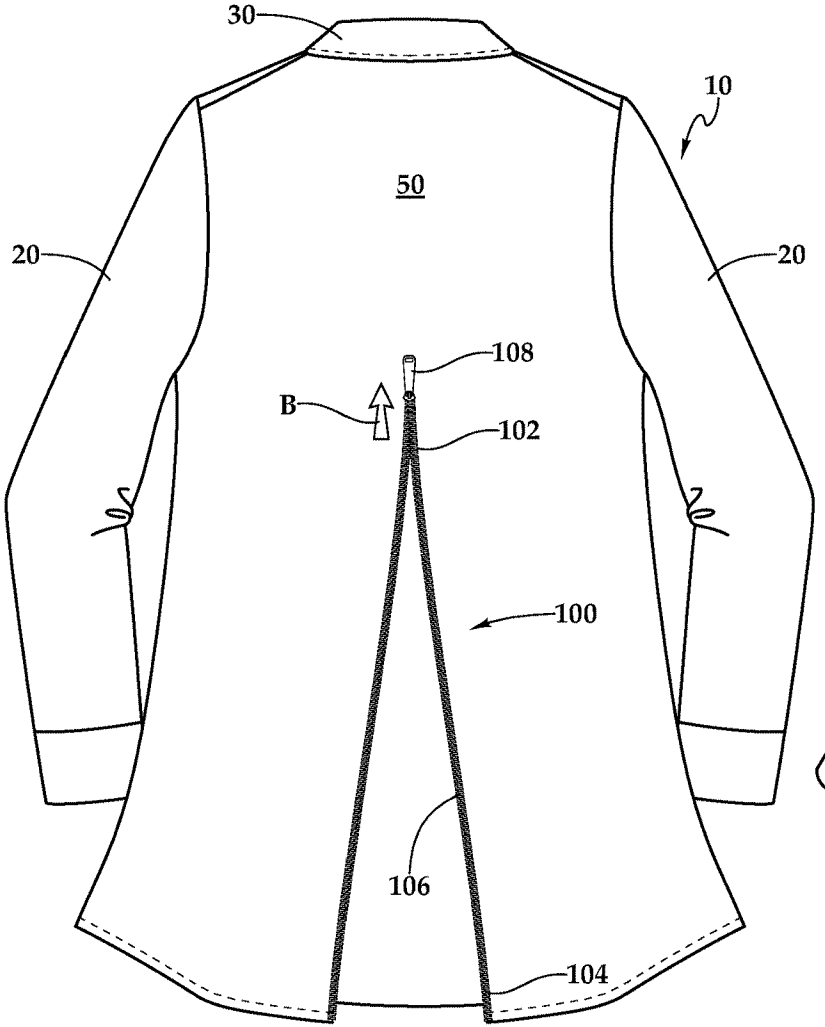
FIG. 3 is an elevation view of that which is shown in FIG. 2, but with the rear closure shown open.

More specifically, and with continuing reference to FIGS. 1-3, further details of the shirt 10 featuring the false button closure of this invention are described, according to this exemplary embodiment. The shirt 10 is a flexible fabric structure which can come in a variety of different shapes and sizes, but is generally configured to cover at least portions of a torso of a wearer. This shirt 10 thus generally includes a neck opening at an upper portion thereof and a body opening at a lower edge thereof. The front 40 generally extends down to a hem 42 while the rear 50 generally extends down to a tail 52, with the hem 42 of the front 40 generally opposite the tail 52 at the rear 50, and with the hem 42 and tail 52 generally providing the same function of defining the lower edge of the shirt 10. In the embodiment shown, this hem 42 and tail 52 can be tucked into trousers, or other clothing worn below the shirt 10 if desired.

The shirt 10 includes armholes 24 at lateral sides between the front 40 and rear 50. In this exemplary embodiment, sleeves 20 connect to these armholes 24, and the sleeves 20 extend between an upper end 22 and a lower end 26. The upper end 22 is sewn to the armholes 24, and with a cuff 28 on the lower end 26. While the sleeves 20 are generally shown as long sleeves, they could alternatively be short sleeves, or no sleeves at all.

The neck opening optimally but preferably is surrounded by a collar 30. This collar 30 is shown having a band 32 with a top button 34 at one end of the band 32 and a top buttonhole 36 at an opposite end of the band 32. The top button 34 and top buttonhole 36 can be fastened together to close the collar 30 tightly around a neck of the wearer, if desired. In other embodiments of the shirt 10, the collar 30 could be omitted, or the band 30 could be of a type which is not closable and either only includes a decorative top button, or no top button 34 at all.

The front 40 and rear 50 can be accessorized, such as by including a pocket or pockets, including decorations thereon for ornamentation, and can be formed of fabric having a desirable appearance and function, and either be plain or with a pattern. Front 40 and rear 50 can be tailored to a greater or lessor extent, to meet the desires of the maker of the shirt 10. Tailoring for a closer fit can be provided if desired, especially for this invention which allows for a tight fitting shirt 10 without the gapping G (FIGS. 8 and 9) of the prior art. Furthermore, with the rear closure 100 (FIGS. 2 and 3) a tightly fitting shirt can still be donned and doffed with relative ease.

Figure 9:
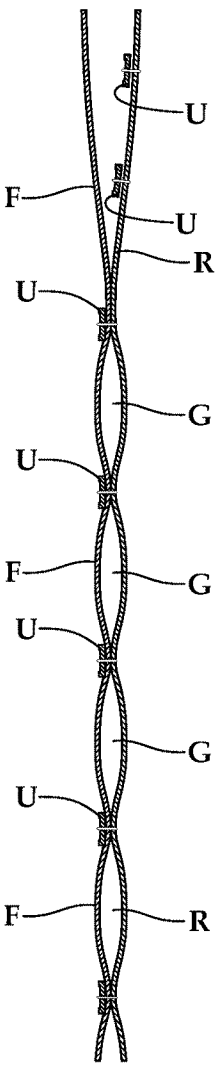
Fig.9 (PRIOR ART)
FIG. 9 is a side elevation sectional view of that which is shown in FIG. 8, further showing gaps present in buttonable fronts of shirts in the prior art.
Figure 8:
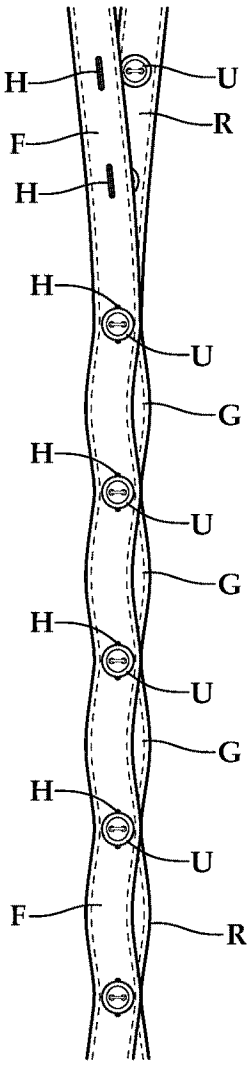
Fig.8 (PRIOR ART)
FIG. 8 is a front elevation view of a buttonable front of a shirt according to the prior art, and which is experiencing gapping between buttons thereof.
Figure 7:
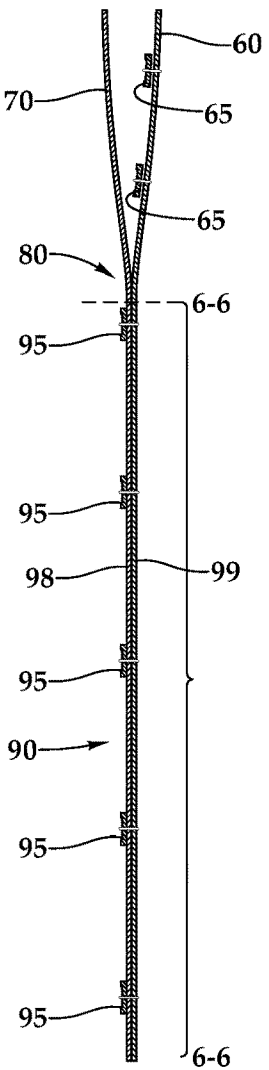
FIG. 7 is a side elevation sectional view of that which is shown in FIG. 6.
Figure 6:
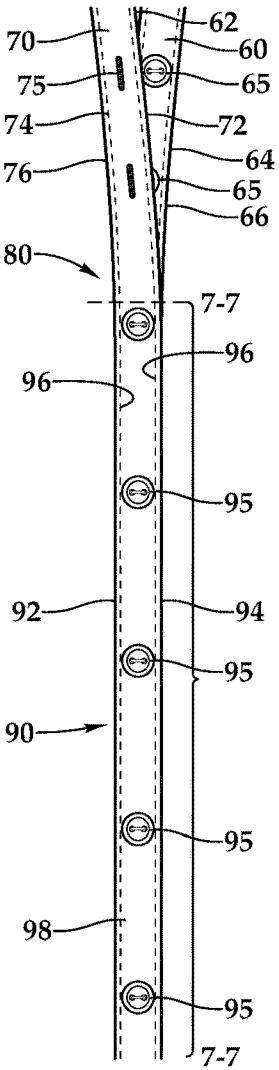
FIG. 6 is a detail of a portion of that which is shown in FIG. 1, showing the front placket, rear placket and false placket which together form the partially openable closure on the front of the shirt of this invention, according to this exemplary embodiment.
Figure 5:
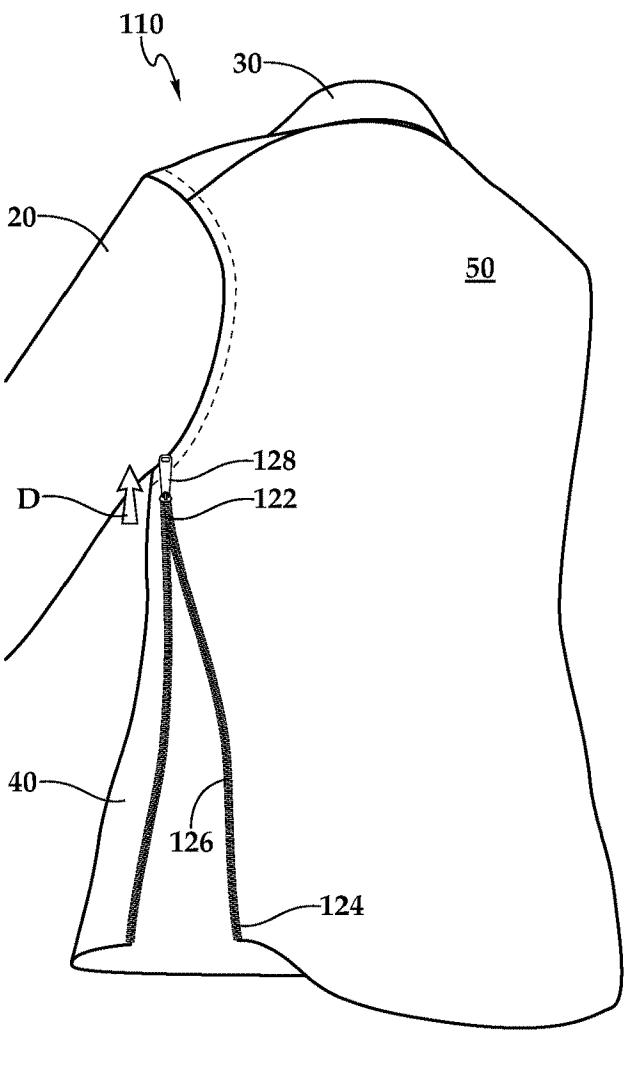
FIG. 5 is a rear perspective view similar to that which is shown in FIG. 4, but with the side closure shown open.

With particular reference to FIGS. 1, 6 and 7, specific details of the partially false button closure on the front 40 of the shirt 10 are described, according to this exemplary embodiment. By way of contrast, FIGS. 8 and 9 show corresponding button front details known in the prior art for a fully openable button front shirt. With such a prior art shirt, a front placket F is provided with buttonholes H periodically thereon. The rear placket R is provided with buttons U periodically located thereon. The buttons U of the rear placket R pass through the buttonholes H in the front packet F. Due to tightness of the shirt 10, gaps G often appear between the buttons U and between the front placket F and the rear placket R. To avoid such gapping, the partially false button closure of this invention is provided.

The rear placket 60 extends down from the collar 30 (or other neck opening) along a vertical centerline of the front 40 of the shirt 10. This rear placket 60 is generally a structure upon which buttons 65 are mounted. The rear placket 60 can have any of a variety of different particular configurations and stylings, with the buttons 65 generally provided on the front surface of the rear placket 60 at regular spacing between adjacent buttons 65. The rear placket 60 has a lateral edge 62 defining a terminus beyond which no connected fabric further extends. A boundary edge 66 is optionally provided opposite the lateral edge 62 and typically generally parallel with the lateral edge 62. This boundary edge 66 defines the edge of the rear placket 60 beyond which, fabric of the front 40 of the shirt 10 is connected and extends. Typically stitching 64 is provided along parallel stitching pathways a standard distance inboard of the lateral edge 62 and boundary edge 66. Other stitching can also optionally be provided on the rear placket 60, either for decorative purposes, or to add further structure and function, such as quilting of multiple layers of fabric if the rear placket 60 is provided with multiple fabric layers. The buttons 65 are typically attached to the rear placket 60 by further stitching, but the buttons 65 can be attached to the rear placket 60 in other matters than stitching.

The front placket 70 is preferably in many ways similar to the rear placket 60, except that it is configured to overlay the rear placket 60 and to include buttonholes 75 rather than the buttons 65. The front placket 70 includes a lateral edge 72 oriented vertically and defining the terminals beyond which no further connected fabric of the front 40 of the shirt 10 extends. The boundary edge 76 is spaced from the lateral edge 72 by a distance which is preferably constant and defining a width of the front placket 70. The boundary edge 76 defines a terminus beyond which fabric forming the front 40 of the shirt 10 is connected and continues. The front placket 70 preferably includes stitching 74, preferably including stitching parallel and inboard of both of the lateral edge 72 and boundary edge 76. Buttonholes 75 are provided at regular spacing along the front placket 70. These buttonholes 75 have a length which is preferably extending vertically, but could extend horizontally or in some other fashion. The buttonholes 75 have a spacing matching spacing between buttons 65 on the rear placket 60. Thus, each buttonhole 75 is preferably spaced from the hem 42 of the front 40 a distance similar to one of the buttons 65, so that each buttonhole 75 can be aligned with one of the buttons 65 for fastening together.

The rear placket 60 and front placket 70, as described above, are in many ways similar to rear plackets R and front plackets F of prior art shirts. However, on a shirt which appears to have a fully openable button closure on the front thereof (FIGS. 8 and 9), such front and rear plackets F. R extend vertically from a neck opening down to a hem. With this invention, the rear placket 60 and front placket 70 terminate at the junction 80. This junction 80 can be provided at a location desired for transitioning between upper portions of the front 40 which are openable and lower portions of the front 40 which are not openable.

In one embodiment, the top button 34 at the collar 30, as well as three buttons 65 (and three buttonholes 75) below the top button 30 are supported upon the rear placket 60 (and front placket 70). Below this, the junction 80 is provided and the false placket 90 is provided and continues downward to the hem 42. Other positions for the junction 80 could alternatively be provided. The junction is preferably concealed so that it defines an important location on the shirt 10, but is not demarcated with any particular stitching, fabric cut, or other indicia which would cause it to be recognized. Rather, most preferably the junction 80 is effectively hidden so that one cannot tell where the rear placket 60 and front placket 70 terminate and the false placket 90 begins.

The false placket 90 includes a first side 92 parallel with and spaced from the second side 94. The sides 92, 94 are preferably each vertically spaced apart with a spacing similar to a width of the front placket 70 between the lateral edge 72 and the boundary edge 76. False buttons 95 are placed on the false placket 90, preferably at mid-spacing between the first side 92 and second side 94 and with similar spacing between adjacent buttons 95, matching spacing between the buttons 65 associated with the rear placket 60. The false buttons 95 are "false" in that they provide only a decorative function and do not open and close the false placket 90.

The false placket 90 can optionally include both a front panel 98 and a rear panel 99. Alternatively, a single panel such as the front panel 98 can be provided for the false placket 90. In one embodiment, the shirt 10 is manufactured by first forming a shirt with full length front and rear plackets 70, 60 and then sewing them together from the hem 42 up to the junction 80.

Stitching 96 preferably is parallel with the first side 92 and second side 94 and slightly inboard of the sides 92, 94. Preferably the stitching 96 lines up with the stitching 74 of the front placket 70, with the stitching 70 of the front placket 70 seamlessly and continuously transitioning from the front placket 70 into the false placket 90. Thus, one cannot tell where the junction 80 is.

The false buttons 95 are provided where the buttonholes 75 in the front placket 70 would be, so that the false placket 90 appears to be the front placket 70 with buttons 65 from the rear placket 60 passing through buttonholes 75 in the front placket 70. However, in reality the false buttons 95 do not pass through buttonholes, but are merely sewn to the false placket 90. In one embodiment, at least portions of buttonholes can be provided on the false placket 90 adjacent to the buttons 95, especially if the buttonholes 75 of the front placket 70 are sufficiently long that portions of these buttonholes 75 appear above or below the buttons 65 when the button 65 are inserted through the buttonhole 75. Thus, the false placket 90 appears exactly as does the front placket 70 as one of the buttons 65 of the rear placket 60 has been inserted through one of the buttonholes 75 and the front placket 70.

To maintain this appearance that the false placket 90 is a continuation of the front placket 70, at least one visual characteristic of the front placket 70 is continued and matched by the false placket 90. These visual characteristics of the front placket include: stitching details such as thread color and type and stitching pattern: edge details including linear, scalloped, finished, unfinished, etc.; fabric color, style, material and pattern; placket width and buttonhole details such as size, shape and stitching. The visual appearance of the buttons 65 and false buttons 95 also have visually matching characteristics, including button size, type, shape, color, fastening method, etc.

A user can optionally have buttons 65 of the rear placket 60 pass through buttonholes 75 in the front placket 70 above the junction 80, so that the junction 80 is not always necessarily at a location just above the highest false button 95 on the false placket 90. With such a configuration, including the false placket 90, the avoidance of gaps G (FIGS. 8 and 9) is provided. Such gaplessness allows for the lateral edges 62, 72 and first side 92 to remain substantially linear, along with maintaining linearity of the boundary edge 66, boundary edge 76 and sides 92, 94. The appearance of an exceptionally well tailored shirt is thus provided, without any such gapping.

With particular reference to FIGS. 2-5, details of additional closures are provided, including the rear closure 100 or side closure 120 on an alternate shirt 110 (FIGS. 4 and 5), according to exemplary embodiments. Such an additional closure is preferred to assist in easily putting on and taking off the shirt 10. In the first embodiment, rear closure 100 is provided along a vertical line at a center of the rear 50 of the shirt 10. This rear closure 100 has an upper end 102 opposite the lower end 104, with the lower end 104 adjacent to the tail 52 of the rear 50. The upper end 102 can be generally at an elevation similar to that of the junction 80, or perhaps somewhat higher or lower.

A zipper 106 is fitted along the rear closure 100 with a pull 108 which allows for opening and closing of the rear closure 100. When the pull 108 is adjacent the upper end 102, the rear closure 100 is open (having been opened by movement of the pull 108 along arrow B of FIG. 3). To close the rear closure 100, the pull 108 is transitioned downward (along arrow A in FIG. 2) to zip closed the rear closure 100. Most preferably, this zipper 106 is a concealed zipper with a concealing hem on either side thereof, so that the zipper 106 is generally not seen when the rear closure 100 is closed. The zipper pull 108 can be low profile and small, so that it is also generally hidden.

With the alternate shirt 110, a side closure 120 is provided as an alternative, which extends beneath at least one of the armholes 24. The side closure 120 is similar to the rear closure 100, in that it has an upper end 122 opposite lower end 124, and with a zipper 126 and associated zipper pull 128. Movement of the zipper 126 downward along arrow C (FIG. 4) closes the side closure 120. Lifting the pull 128 of the zipper 126 upward (along arrow D of FIG. 5) opens the side closure 120. In one embodiment, and when the shirt is sleeveless, the side closure 120 could pass entirely up to the armhole 24 for lateral openability of the shirt 10 a similar rear full openability could also be facilitated if the upper end 102 at the rear closure 100 extended all the way up to the neck opening of the shirt 10, as an alternative.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A shirt, comprising in combination:

a front opposite a rear;

said front extending from a neck opening down to a lower edge;

a rear placket at upper portions of a vertical centerline of said front, said rear placket having at least one button on a forward facing surface thereof;

a front placket at upper portions of said vertical centerline of said front, said front placket having at least one buttonhole therethrough;

said at least one buttonhole located a similar distance from said lower edge of said front as said at least one button;

said at least one button sized to fit within said at least one buttonhole for selective attachment and detachment of said front placket to said rear placket;

a false placket along at least a portion of said vertical centerline of said front beneath at least portions of said front placket and beneath at least portions of said rear placket, said false placket having at least one false button thereon, and said false placket being unopenable;

said false placket having an appearance matching at least some visual characteristics of said front placket which are apparent when said front placket is fastened to said rear placket by having said at least one button of said rear placket fastened to said at least one buttonhole of said rear placket, and with said false button of said false placket having an appearance matching at least some visual characteristics of said at least one button of said rear placket; and wherein said front placket includes vertical stitching thereon, wherein said false placket includes vertical stitching thereon, and wherein said vertical stitching on said front placket and said vertical stitching on said false placket are of similar form and aligned co-extensive with each other to form the appearance of continuous vertical stitching over both said front placket and said false placket.

2. The shirt of claim 1 wherein a junction is adjacent to an upper end of said false placket and a lower end of said rear placket and a lower end of said front placket.

3. The shirt of claim 1 wherein said shirt includes armholes on lateral side of said front.

4. The shirt of claim 3 wherein at least portions of a sleeve are coupled to each of said armholes of said shirt.

5. The shirt of claim 1 wherein a collar with a band is located above said front of said shirt and around said neck opening, said band including a top button and a top buttonhole.

6. The shirt of claim 5 wherein said top button matches said at least one button on said rear placket and said at least one false button on said false placket.

7. The shirt of claim 1 wherein said false placket includes at least portions of buttonhole stitching thereon, behind said at least one false button, said buttonhole stitching on said false placket matching buttonhole stitching on said front placket.

8. The shirt of claim 1 wherein a rear closure is provided on said rear of said shirt, said rear closure selectively openable.

9. A button front shirt with an at least partially false button closure, the button front shirt, comprising in combination:

a front opposite a rear;

said front extending from a neck opening down to a lower edge;

a rear placket at upper portions of a vertical centerline of said front, said rear placket having at least one button on a forward facing surface thereof;

a front placket at upper portions of said vertical centerline of said front, said front placket having at least one buttonhole therethrough;

said at least one buttonhole located a similar distance from said lower edge of said front as said at least one button;

said at least one button sized to fit within said at least one buttonhole for selective attachment and detachment of said front placket to said rear placket;

a false placket along at least a portion of said vertical centerline of said front beneath at least portions of said front placket and beneath at least portions of said rear placket; and wherein said front placket includes vertical stitching thereon, wherein said false placket includes vertical stitching thereon, and wherein said vertical stitching on said front placket and said vertical stitching on said false placket are of similar form and aligned co-extensive with each other to form the appearance of continuous vertical stitching over both said front placket and said false placket.

10. The button front shirt of claim 9 wherein said false placket has at least one false button thereon, and said false placket being unopenable.

11. The button front shirt of claim 10 wherein said false placket has an appearance matching at least some characteristics of said front placket when said front placket is fastened to said rear placket by having said at least one button of said rear placket fastened to said at least one buttonhole of said rear placket, and with said false button of said false placket having an appearance matching at least some visual characteristics of said at least one button of said rear placket.

* * * * *